US008467700B2

(12) United States Patent
Okabe

(10) Patent No.: US 8,467,700 B2
(45) Date of Patent: Jun. 18, 2013

(54) CONFIGURATION FOR A CARTRIDGE USABLE IN AN IMAGE FORMING APPARATUS

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 272 days.

(21) Appl. No.: 12/712,449

(22) Filed: Feb. 25, 2010

(65) Prior Publication Data

US 2010/0215396 A1 Aug. 26, 2010

(30) Foreign Application Priority Data

Feb. 25, 2009 (JP) ..... 2009-041888

(51) Int. Cl.
*G03G 15/00* (2006.01)

(52) U.S. Cl.
USPC ..... 399/110; 399/111; 399/119

(58) Field of Classification Search
USPC ..... 399/110, 111, 119
See application file for complete search history.

(56) References Cited

U.S. PATENT DOCUMENTS

| | | | | |
|---|---|---|---|---|
| 7,356,301 | B2 | 4/2008 | Onodera | |
| 7,555,255 | B2 | 6/2009 | Onodera | |
| 2007/0297840 | A1 | 12/2007 | Onodera | |
| 2008/0131149 | A1 | 6/2008 | Onodera | |
| 2008/0159774 | A1 | 7/2008 | Tanabe et al. | |
| 2008/0292355 | A1 * | 11/2008 | Sakurai et al. | 399/110 |
| 2010/0135691 | A1 * | 6/2010 | Kikuchi | 399/111 |

FOREIGN PATENT DOCUMENTS

| | | | |
|---|---|---|---|
| JP | S58-182585 | | 12/1983 |
| JP | H3-111995 | | 11/1991 |
| JP | 3050126 | | 4/1998 |
| JP | 10-246033 | | 9/1998 |
| JP | 2001115540 | A | 4/2001 |
| JP | 1125836 | | 11/2001 |
| JP | 3114152 | | 9/2005 |
| JP | 2008003294 | A | 1/2008 |
| JP | 2008-165026 | | 7/2008 |
| JP | 2009003413 | A | 1/2009 |

OTHER PUBLICATIONS

Notification of Reasons for Refusal for Japanese patent application No. 2009-041888 mailed Mar. 8, 2011.
The First Office Action for Chinese patent application No. 201010127160.4 mailed Feb. 22, 2012.

* cited by examiner

*Primary Examiner* — Ryan Walsh
(74) *Attorney, Agent, or Firm* — Banner & Witcoff, Ltd.

(57) ABSTRACT

A cartridge is detachably mountable in a receiving area of an image forming apparatus in a first direction. The receiving area is partitioned by partition surfaces opposing each other in a direction orthogonal to the first direction. The cartridge includes first and second side surfaces in the opposing direction. In a part of the case, both ends of which are contactable with the partition surfaces, respectively, when mounted in the receiving area, outlines of the first and second side surfaces are provided on or inside first and second circular arcs, respectively, as seen in a second direction orthogonal to the opposing direction and the first direction. Each circular arc has a center, in the part, at corresponding end in the opposing direction and at a most upstream end in a mounting direction, and a radius corresponding to a line segment connecting the both ends in the opposing direction.

12 Claims, 15 Drawing Sheets

CONFIGURATION FOR A CARTRIDGE USABLE IN AN IMAGE FORMING APPARATUS

CROSS-REFERENCE TO RELATED APPLICATION

This application claims priority from Japanese Patent Application No. 2009-041888, filed on Feb. 25, 2009, the entire subject matter of which is incorporated herein by reference.

TECHNICAL FIELD

Aspects of the present invention relate to a cartridge to be mounted in an image forming apparatus.

BACKGROUND

A cartridge such as a process cartridge configured to form an image is known. An image forming apparatus includes a plurality of process cartridges mounted therein, wherein the plurality of process cartridges respectively store developer having different colors. Specifically, the image forming apparatus includes a tray provided to be drawable from an apparatus body in the horizontal direction. The tray includes a pair of side walls provided to oppose each other with a predetermined distance therebetween. The plurality of process cartridges are held in the tray to be parallel with each other in the horizontal direction between the pair of wails. In a state where the tray is drawn from the apparatus body, a process cartridge can be taken out by pulling up the process cartridge from the tray.

In the image forming apparatus, each of the process cartridges held in the tray opposes each of the side walls of the tray with a small distance therebetween. The process cartridge and each side wall have opposing surfaces which oppose each other, and the opposing surfaces are flat in the upper-lower direction.

Therefore, while the process cartridge is pulled up from the tray, if the posture of the process cartridge is inclined by even a small amount, there is a concern that the process cartridge is hung on the side walls of the tray, so that the pulling up operation of the process cartridge can become not smooth. Similarly, while the process cartridge is mounted in the tray from above, the same problem can occur.

In other to smoothly pull up (mount in) the process cartridge, it is conceivable to increase the distance between the process cartridge and the respective side walls of the tray. However, if the distance were increased by a large amount, the process cartridge became likely to unnecessarily rattle in a state where the process cartridge is provided between the pair of side walls. For example, in the state where the process cartridge is provided between the pair of the side walls, when a driving force or power is applied to the process cartridge from the apparatus body through each of the side walls, it is difficult to stably apply a driving force or power to the process cartridge since the process cartridge is unstable. Accordingly, the rattling of the process cartridge between the pair of side walls needs to be suppressed as much as possible.

SUMMARY

Accordingly, it is an aspect of the present invention to provide a cartridge which can be smoothly mounted in or detached from a receiving area of an apparatus body of an image forming apparatus while suppressing rattling in a mounted state in the receiving tray.

According to an exemplary embodiment of the present invention, there is provided a cartridge which is detachably mountable in a receiving area of an apparatus body of an image forming apparatus in a first direction, the receiving area being partitioned by a pair of partition surfaces opposing each other with a predetermined distance therebetween, the first direction being orthogonal to an opposing direction of the partition surfaces. The cartridge comprises a case which is long in the opposing direction and is configured to store developer. The case includes first and second side surfaces in the opposing direction. In a contactable part of the case, both ends of which are contactable with the pair of partition surfaces, respectively, when mounted in the receiving area, an outline of the first side surface is provided on or inside a first circular arc as seen in a second direction orthogonal to the opposing direction and the first direction. The first circular arc has a first center of curvature positioned at a second end provided at a side of the second side surface in the opposing direction and positioned at a most upstream end in a mounting direction parallel to the first direction with respect to the receiving area, in the contactable part, and a first radius of curvature corresponding to a line segment connecting a first end provided at a side of the first side surface in the opposing direction and the second end, at the most upstream end in the mounting direction with respect to the receiving area, in the contactable part. In the contactable part, an outline of the second side surface is provided on or inside a second circular arc as seen in the second direction. The second circular arc has a second center of curvature positioned at the first end in the opposing direction and positioned at the most upstream end in the mounting direction with respect to the receiving area, in the contactable part, and a second radius of curvature corresponding to the line segment.

According to an exemplary embodiment of the present invasion, there is provided a cartridge which is detachably mountable in a receiving area of an apparatus body of an image forming apparatus in a first direction, the receiving area being partitioned by a pair of side wails opposing each other with a predetermined distance therebetween, the first direction being orthogonal to an opposing direction of the side walls. The cartridge comprises a case. The case includes first and second side surfaces opposing in the opposing direction, an upper surface, and a lower surface; first and second protruding portions protrude from the first and second side surfaces, respectively, in the opposing direction, the first and second protruding portions being configured to contact edges of the side walls, respectively, when mounted in the receiving area; a developing roller provided between the first and second side surfaces; a grip part which is provided on the upper surface at a position between a center of the case and the second side surface in the opposing direction. An outline of the second side surface between the lower surface and the second protruding portion is provided on or inside a circular arc as seen in a second direction orthogonal to the opposing direction and the first direction. The circular arc has a center of curvature at which the first protruding portion protrudes from the first side surface, and a radius of curvature corresponding to a line segment connecting a position at which the first protruding portion protrudes from the first side surface and a position at which the second protruding portion protrudes from the second side surface.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will be described with reference to the accompanying drawings.

1. Structure of Printer

Figure 1:
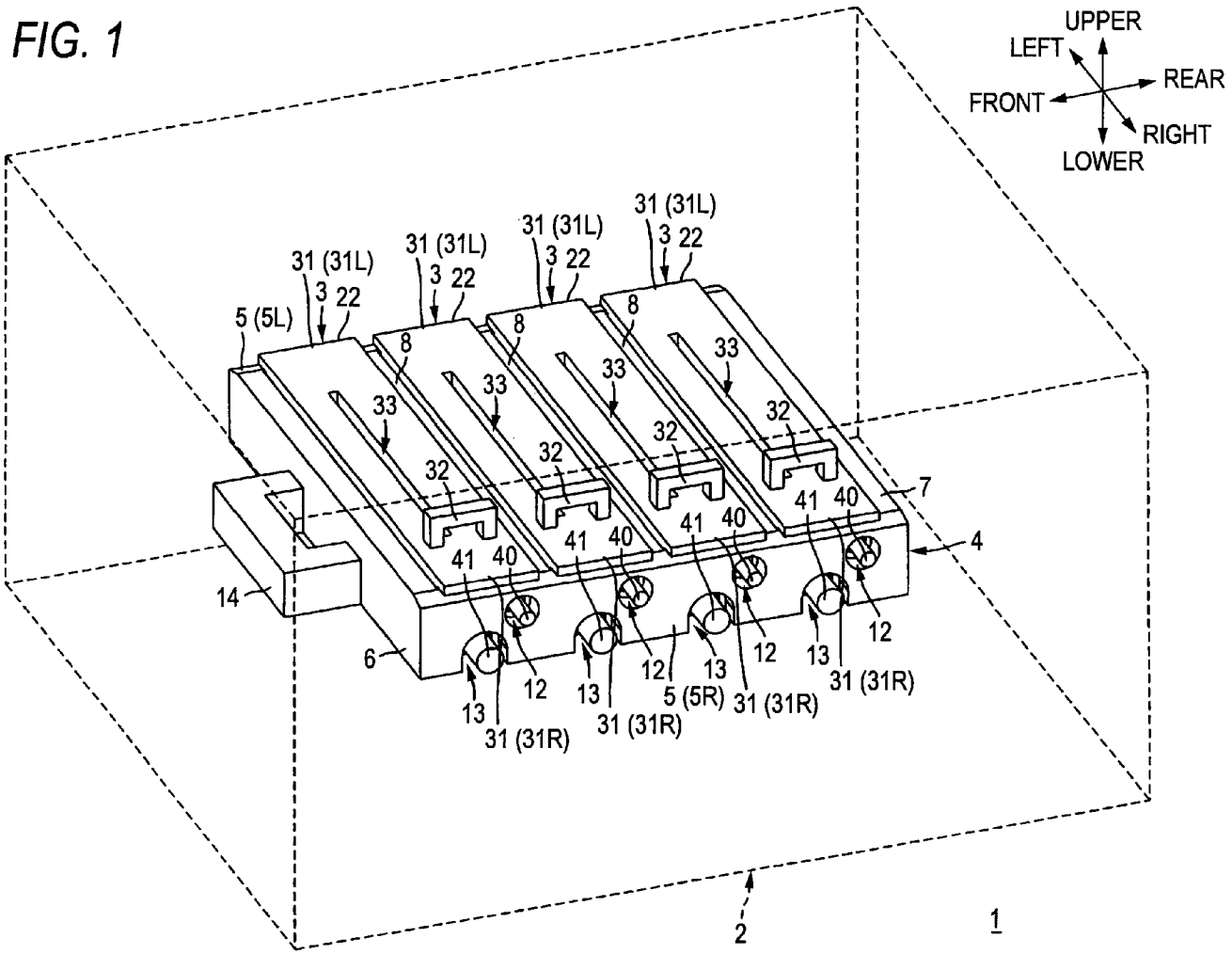
FIG. 1 is a schematic perspective view of a printer as an example of an image forming apparatus in a state where cartridges according to an exemplary embodiment of the present invention are mounted, as seen from the right front side.

A printer 1 is shown in FIG. 1 as an example of an image forming apparatus. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as the width direction, and the upper-lower direction is also referred to as the vertical direction. The left-right direction and the front-rear direction are also referred to as a horizontal direction. With regard to various individual components of the printer 1, sides of the individual components are similarly identified based on the arranged/attached position of the components on/in the printer 1.

The printer 1 is, for example, a laser printer. The printer 1 includes a body casing 2 (as an example of an apparatus body). A plurality (four) of cartridges 3 are mounted in the body casing 2 to be in parallel with each other and arrayed in the front-rear direction.

Further, a holder 4 configured to hold the cartridges 3 is provided in the body casing 2. The holder 4 can be drawn from, for example, the front side of the body casing 2 while holding the cartridges 3. When the holder 4 is drawn from the body casing 2, each of the cartridges 3 can be mounted in or detached from the holder 4 from above.

However, the holder 4 may be integrated (fixed) to the body casing 2 as a part of the body casing 2. In this case, the upper surface of the body casing 2 is opened and the upper portion of the holder 4 is exposed to the outside, so that each of the cartridges 3 can be mounted in or detached from the holder 4 (in other words, the body casing 2) from above.

The holder 4 and the respective cartridges 3 will be described below.

(1) Holder

Figure 2:
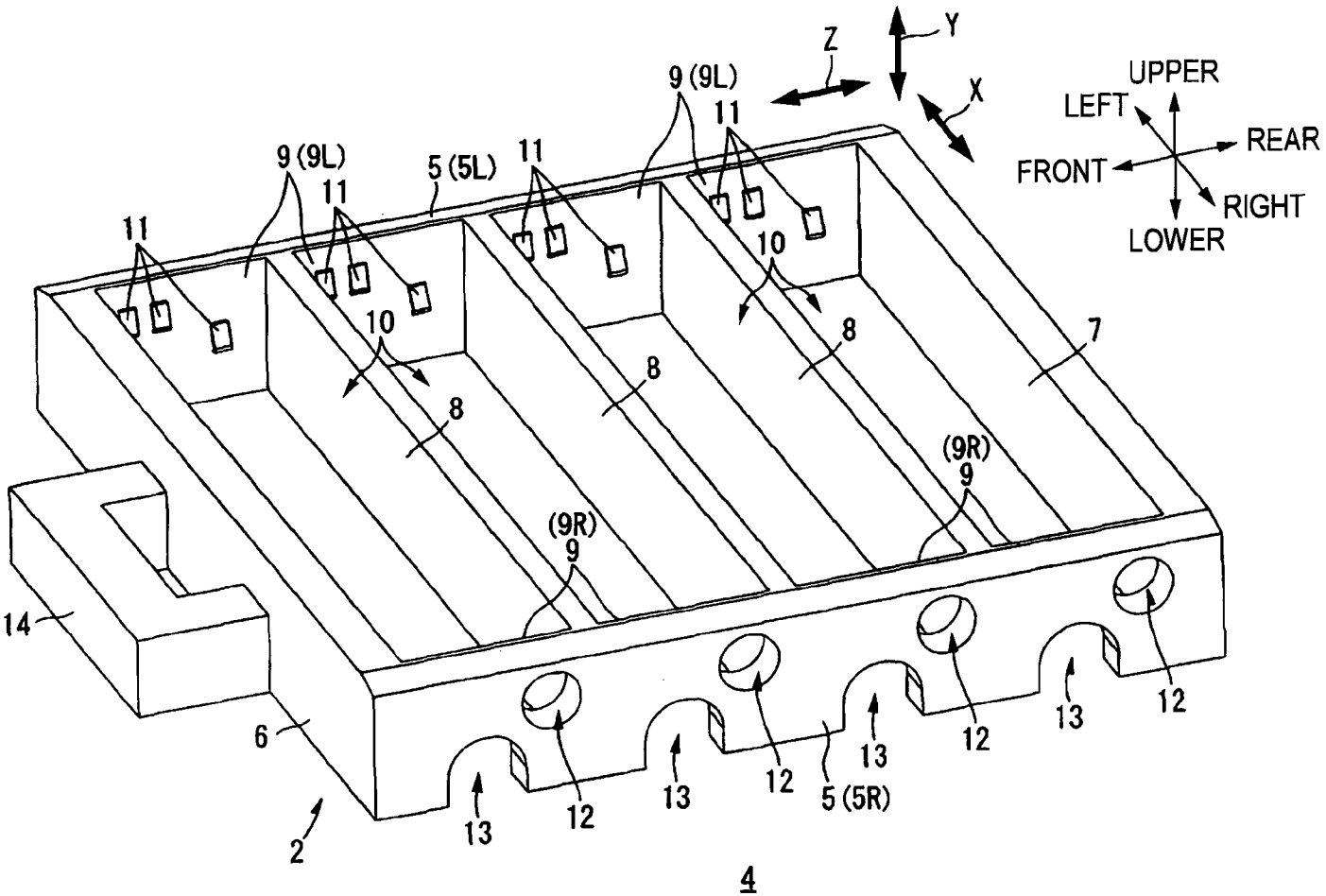
FIG. 2 is a perspective view of a holder as seen from the right front side.

The holder 4 shown in FIG. 2 is formed in a frame having a rectangular shape which is long in the front-rear direction in plan view.

Specifically, the holder 4 includes a pair of side plates 5, a front plate 6, a rear plate 7, and three partition plates 8 which are integrally formed. The pair of side plates 5 are provided so as to oppose each other with a predetermined distance therebetween in the width direction. The front plate 6 is provided between the front ends of the pair of side plates 5. The rear plate 7 is provided between the rear ends of the pair of side plates 5. The three partition plates 8 are provided between the side plates 5 to be in parallel with each other between the front and rear plates 6 and 7 at regular intervals in the front-rear direction. The front plate 6, the rear plate 7, and the three partition plates 8 have substantially the same size and a rectangular shape which is long in the width direction and thin in the front-rear direction.

The pair of side plates 5 include a left side plate 5L which is provided on the left side, and a right side plate 5R which is provided on the right side. Each of the side plates 5 has a rectangular shape which is long in the front-rear direction and thin in the width direction.

The surfaces of the pair of side plates 5, which oppose each other in the width direction, (the right side surface of the left side plate 5L and the left side surface of the right side plate 5R) configure a pair of partition surfaces 9 which are provided so as to oppose each other with a predetermined distance therebetween in the width direction. Herein, the opposing direction X of the pair of partition surfaces 9 is the width direction. A direction orthogonal to the opposing direction X is the upper-lower direction (the vertical direction) and is defined as a first direction Y. Furthermore, a direction orthogonal to both the opposing direction X and the first direction Y is the front-rear direction and is defined as a second direction Z.

The pair of partition surfaces 9 includes a left partition surface 9L which is provided on the left side (the right side surface of the left side plate 5L), and a right partition surface 9R which is provided on the right side (the left side surface of the right side plate 5R). Each of the partition surfaces 9 has a flat vertical surface which extends in the front-rear direction and the upper-lower direction.

Further, a space surrounded by the pair of side plates 5 (specifically, the pair of partition surfaces 9) and the front and rear plates 6 and 7 is partitioned into four receiving areas 10 by the three partition plates 8 to be aligned in the front-rear direction. The four receiving areas 10 have the same size, and each of the receiving areas 10 is partitioned in the shape of a rectangular parallelepiped which is long in the width direction. Each of the receiving areas 10 is opened on both the upper and lower sides.

Specifically, in the front-rear direction, the receiving areas 10 are partitioned by the front plate 6 and the front partition plate 8 which are adjacent to each other, the partition plates 8 which are adjacent to each other, and the rear partition plate 8 and the rear plate 7 which are adjacent to each other. In the width direction, the receiving areas are partitioned by the pair of partition surfaces 9.

Three electrodes 11 including a leaf spring member made of metal are provided at each of the portions of the left side plate 5L which correspond to the respective receiving areas 10 in the front-rear direction. Among the three electrodes 11 corresponding to each receiving area 10, two electrodes 11 are provided so as to be aligned in the front-rear direction and the other electrode 11 is provided on the rear lower side of the two electrodes 11 to be spaced apart from the two electrodes 11.

Further, each of the electrodes 11 is exposed to the left partition surface 9L while opposing the inside of the corresponding receiving area 10, and is also exposed to the left side surface of the left side plate 5L (see FIG. 5A to be described below). Each of the electrodes 11 has an elastic force and slightly protrudes toward the right lower side and inside the corresponding receiving area 10. Furthermore, the portion of each of the electrodes 11, which is exposed to the left side surface of the left side plate 5L (see FIG. 5A), is connected to a power source (not shown) of the body casing 2.

An insertion hole 12 and a notch 13 are formed at each of the portions of the right side plate 5R which correspond to the respective receiving areas 10 in the front-rear direction. Each of the insertion holes 12 is a circular hole which passes through the right side plate 5R in the width direction and communicates with the corresponding receiving area 10. Each of the notches 13 has a substantially semicircular shape which bulges upward, passes through the right side plate 5R in the width direction, and communicates with the corresponding receiving area 10. As for the insertion hole 12 and the notch 13 corresponding to each of the receiving areas 10, the notch 13 is positioned at the lower end of the right side plate 5R and the insertion hole 12 is positioned on the rear upper side of the notch 13 (at the upper end portion of the right side plate 5R).

Further, a substantially U-shaped handle 14 is integrally formed on the front surface of the front plate 6 at a middle portion in the width direction. The handle 14 can be gripped to draw the holder 4 from the body casing 2 as described above.

(2) Cartridge

Figure 3A:
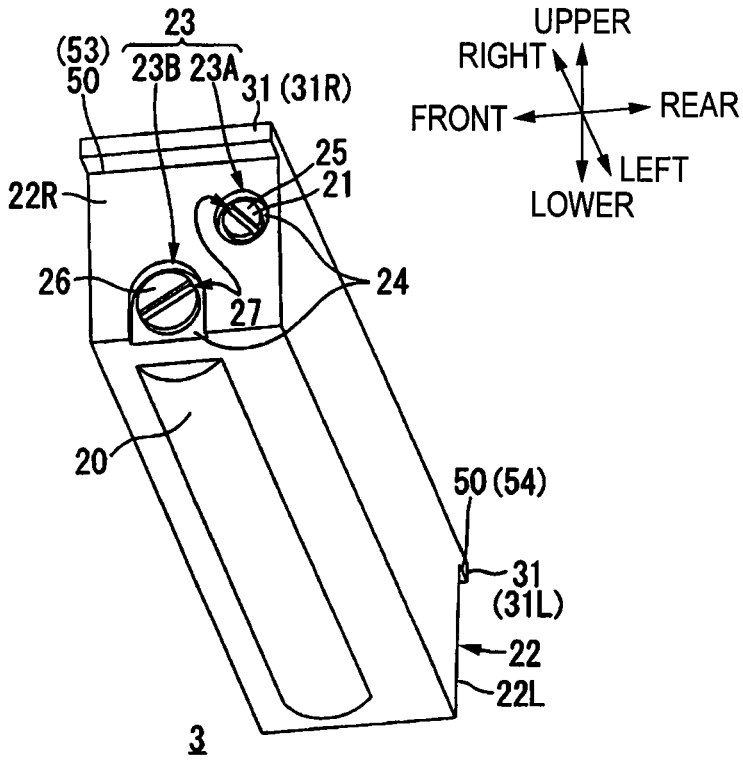
FIG. 3A is a perspective view of the cartridge as seen from the right rear side.
Figure 3B:
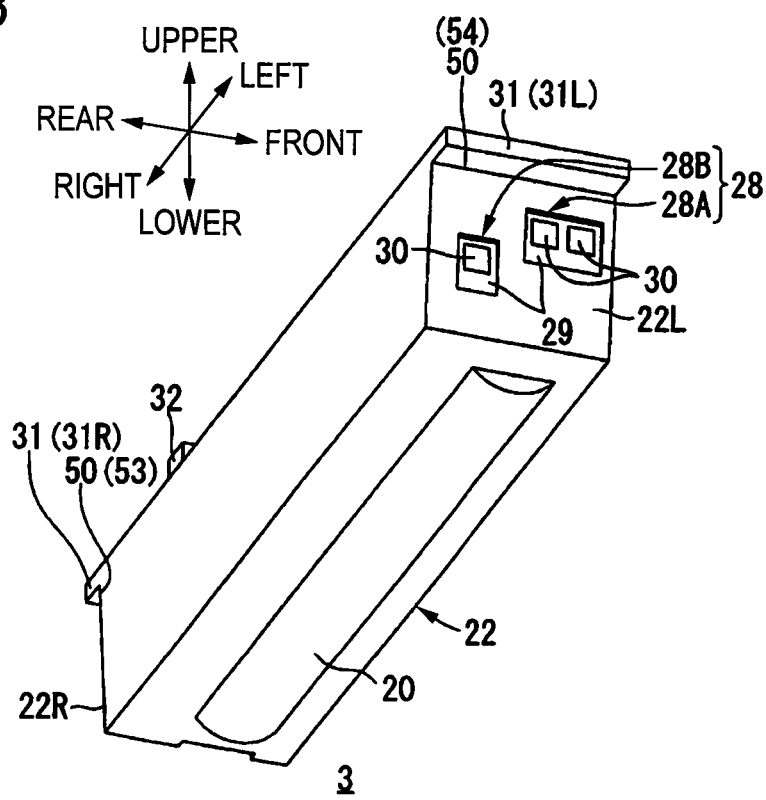
FIG. 3B is a perspective view of the cartridge as seen from the left rear side.

The cartridge 3 shown in FIGS. 3A and 3B stores at least developer (toner) which is used to form an image in the printer 1 (see FIG. 1). The cartridge 3, which is described as an example, is a process cartridge which includes a photosensitive drum 20 and a developing roller 21. An electrostatic latent image is formed on the photosensitive drum 20, and the developing roller 21 develops the electrostatic latent image by supplying toner to the electrostatic latent image which is formed on the photosensitive drum 20. Meanwhile, the cartridge 3 may be a developing cartridge which does not include a photosensitive drum 20 and includes a developing roller 21.

The photosensitive drum 20 and the developing roller 21 (as an example of a driven member) are driven to rotate about the central axes thereof as described below, respectively.

The cartridge 3 includes a case 22 which configures the outline of the cartridge, and the photosensitive drum 20 and the developing roller 21 are rotatably supported by the case 22. The case 22 has a box shape which is long in the width direction (the opposing direction X to be described above), and stores toner.

The outer surfaces of the case 22 are defined by substantially flat upper and lower surfaces which are parallel to the horizontal direction, substantially flat front and rear surfaces which are parallel to the vertical direction, and left and right side surfaces 22L and 22R which opposes each other in the opposing direction X. Assuming that the left side surface 22L is referred to as one (first) side surface, the right side surface 22R is referred to as the other (second) side surface. In contrast, assuming that the right side surface 22R is referred to as one (first) side surface, the left side surface 22L is referred to as the other (second) side surface. In the following description, the left side surface 22L is referred to as one (first) side surface and the right side surface 22R is referred to the other (second) side surface.

Both the left and right side surfaces 22L and 22R are not a flat surface which is parallel to the vertical direction (the first direction Y). The detailed of the left and right side surfaces 22L and 22R will be described later.

As shown in FIG. 3A, the right side surface 22R has two right recesses 23 which are recessed inward in the width direction (toward the left side). The two right recesses 23 includes a first right recess 23A which is provided at the upper rear end of the right side surface 22R, and a second right recess 23B which is provided at the lower end of the right side surface 22R on the front lower side of the first right recess 23A. As seen from the right side, the first right recess 23A has a circular shape and the second right recess 23B has a semicircular shape which bulges upward.

Each of the right recesses 23 of the right side surface 22R has a flat surface (referred to as a right flat surface 24) which is parallel to the vertical direction (the first direction Y). The right flat surface 24 defines the bottom of each of the right recesses 23.

A first transmission part 25 is provided on the right flat surface 24 of the first right recess 23A so as to be completely within the first right recess 23A, and a second transmission part 26 is provided on the right flat surface 24 of the second right recess 23B so as to be completely within the second right recess 23B. In other words, the first and second transmission parts 25 and 26 are positioned inward in the width direction (on the left side) with respect to the right side surface 22R and do not protrude from the right side surface 22R outward in the width direction (toward the right side) (see FIG. 8 to be described below).

Each of the first and second transmission parts 25 and 26 has a circular disk shape as seen from the right side and is thin in the width direction. A groove 27, which is recessed toward the left side, is formed on the right side surface of each of the first and second transmission parts 25 and 26. Each of the grooves 27 passes through the center of the circular shape of the corresponding one of the transmission parts 25, 26 and linearly extends in the radial direction of the transmission part 25, 26.

The fast transmission part 25 is connected to the right end of a rotating shaft of the developing roller 21 and is formed integrally with the developing roller 21. The second transmission part 26 is connected to the right end of a rotating shaft of the photosensitive drum 20 and is formed integrally with the photosensitive drum 20. As described below, the first transmission part 25 is configured to receive a driving force from the body casing 2 (see FIG. 1) and transmit the driving force to the developing roller 21. The second transmission part 26 is configured to receive a driving force from the body casing 2 and transmit the driving force to the photosensitive drum 20.

Meanwhile, as shown in FIG. 3B, the left side surface 22L has two left recesses 28 which are recessed inward in the width direction (toward the right side) and aligned in the front-rear direction. The two left recesses include a first left recess 28A which is provided at front side, and a second left recess 28B which is provided at rear side. The dimension of the first left recess 28A in the front-rear direction is about twice as large as the dimension of the second left recess 28B in the front-rear direction.

Each of the left recesses 28 of the left side surface 22L has a flat surface (referred to as a left flat surface 29) which is parallel to the vertical direction (the first direction Y). The left flat surface 29 defines the bottom of each of the left recesses 28.

Electrodes 30 are provided on the left flat surfaces 29 of the respective left recesses 28. Specifically, two electrodes 30 are provided on the left flat surface 29 of the first left recess 28A to be aligned in the front-rear direction, and one electrode 30 is provided on the left flat surface 29 of the second left recess 28B. Each of the electrodes 30 is positioned inward in the width direction (on the right side) with respect to the left side surface 22L, and do not protrude from the left side surface 22L outward in the width direction (toward the left side) (see FIG. 8 to be described below). As described below, each of the electrodes 30 is configured to receive power from the body casing 2 (see FIG. 1) and supply the power to a member disposed in the case 22 (the photosensitive drum 20 or developing roller 21 etc.).

From the lower surface of the case 22, the outer peripheral surface of the photosensitive drum 20 is exposed to the outside.

On both ends of the upper surface of the case 22 in the width direction, protruding portions 31 which protrude outward in the width direction are integrally formed. Each of the protruding portions 31 is provided on the corresponding end of the upper surface of the case 22 entirely in the front-rear direction. The left protruding portion 31L protrudes from the left side surface 22L toward the left side, and the right protruding portion 31R protrudes from the side surface 22R toward the right side. It is noted that the protruding portions 31 may be provided on the corresponding end of the upper surface of the case 22 not entirely in the front-rear direction.

One grip part 32 is integrally formed on the upper surface of the case 22 at a position apart (for example, toward the right side) from the center of the upper surface (which also includes the left and right protruding portions 31) of the case 22 in the width direction (see also FIG. 1). In other words, the grip part 32 is provided on the upper surface at a position between the center of the upper surface and the right side surface 22R in the width direction.

A through hole 33, which is long in the width direction, is formed at a position avoiding the grip part 32 on the upper surface of the case 22 (see FIG. 1). During an image formation, a laser beam generated from the body casing 2 passes through the through holes 33 of the respective cartridges 3 and the outer peripheral surfaces of the photosensitive drums 20 are irradiated with the laser beam, so that electrostatic latent images are formed on the outer peripheral surfaces of the photosensitive drums 20.

(3) Mounting and Detaching of Cartridge in or from Holder

The mounting or detaching of the cartridge 3 in or from the holder 4 will be described below. If the holder 4 is configured to be drawable from the body casing 2 (see FIG. 1) as described above, the cartridge 3 is mounted in or detached from the holder 4 in a state where the holder 4 is drawn from the body casing 2. Meanwhile, if the holder 4 is fixed to the body casing 2, the upper surface of the body casing 2 is opened and the cartridge 3 is mounted in or detached from the holder 4 which is exposed to the upper side.

Figure 4:
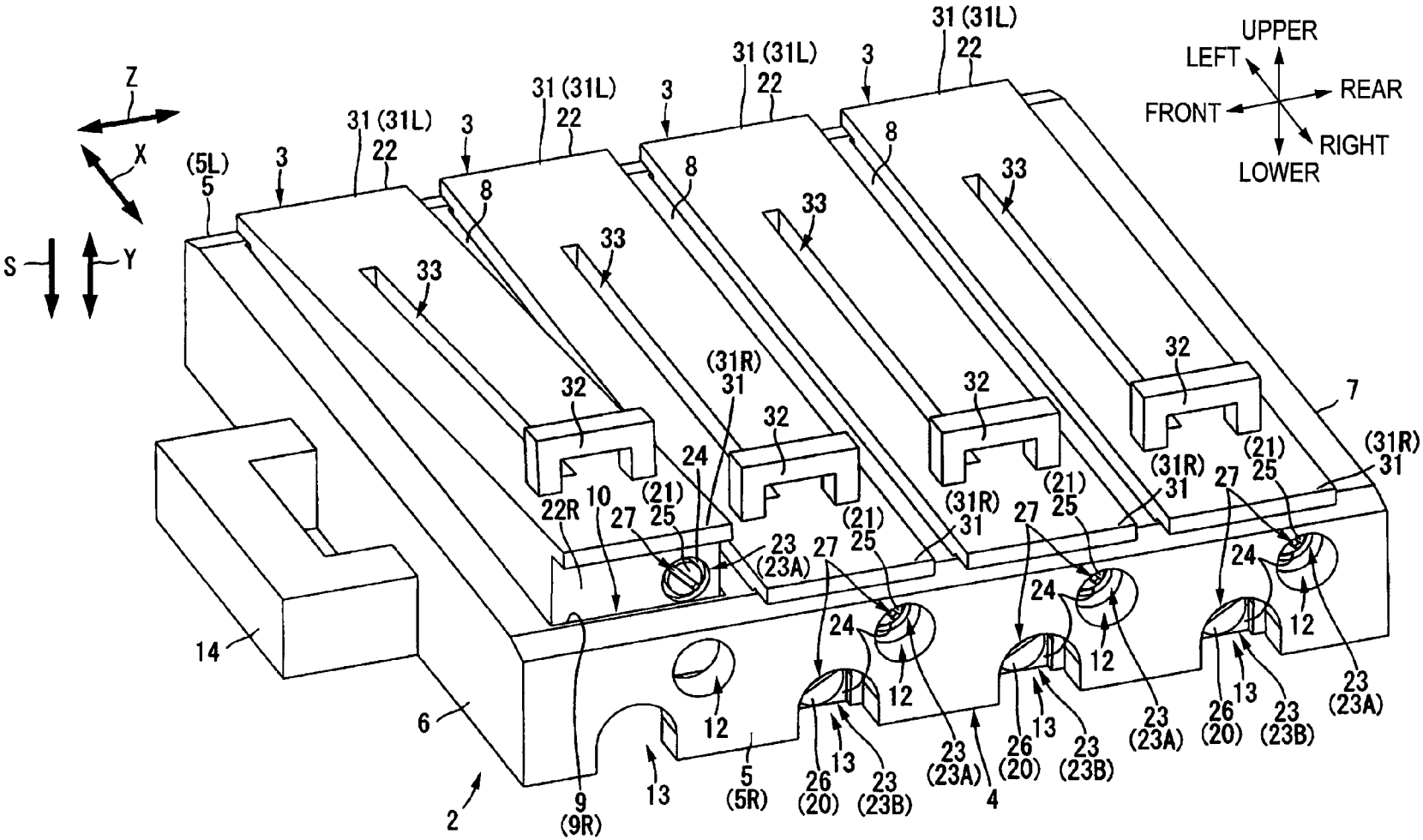
FIG. 4 is a perspective view illustrating a procedure for mounting or detaching the cartridge to or from the holder.

As shown in FIG. 4, the respective cartridges 3 are detachably mounted in the holder 4 (specifically, the corresponding receiving areas 10, see FIG. 2) from above in the upper-lower direction (the first direction Y). Therefore, a mounting direction S in which the cartridge 3 is mounted on the holder 4 (the receiving area 10) is parallel to the first direction Y and faces the lower side. Accordingly, the upper surface of the case 22 of the cartridge 3 is considered as an upstream end portion of the case 22 in the mounting direction S.

When the cartridge 3 is mounted in or detached from the receiving area 10, the grip part 32 is gripped. As described above, the grip part 32 is provided on the upper surface of the case 22 of the cartridge 3 at a position apart toward the right side from the center of the upper surface of the case 22 in the width direction. Therefore, when the grip part 32 is gripped and the cartridge 3 is mounted in or detached from the receiving area 10, as seen in the front-rear direction (the second direction Z), the entire cartridge 3 is inclined so that the left portion of the cartridge is lower than the right portion thereof (see the foremost cartridge 3 in FIG. 4).

In FIG. 4, only the foremost cartridge 3 is not completely mounted in the holder 4.

Figure 5B:
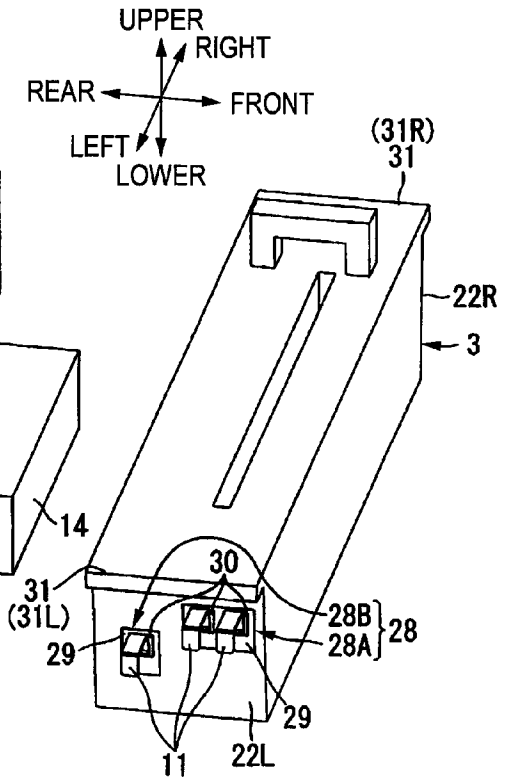
FIG. 5B is a perspective view of one cartridge mounted on the holder as seen from the left front side.
Figure 5A:
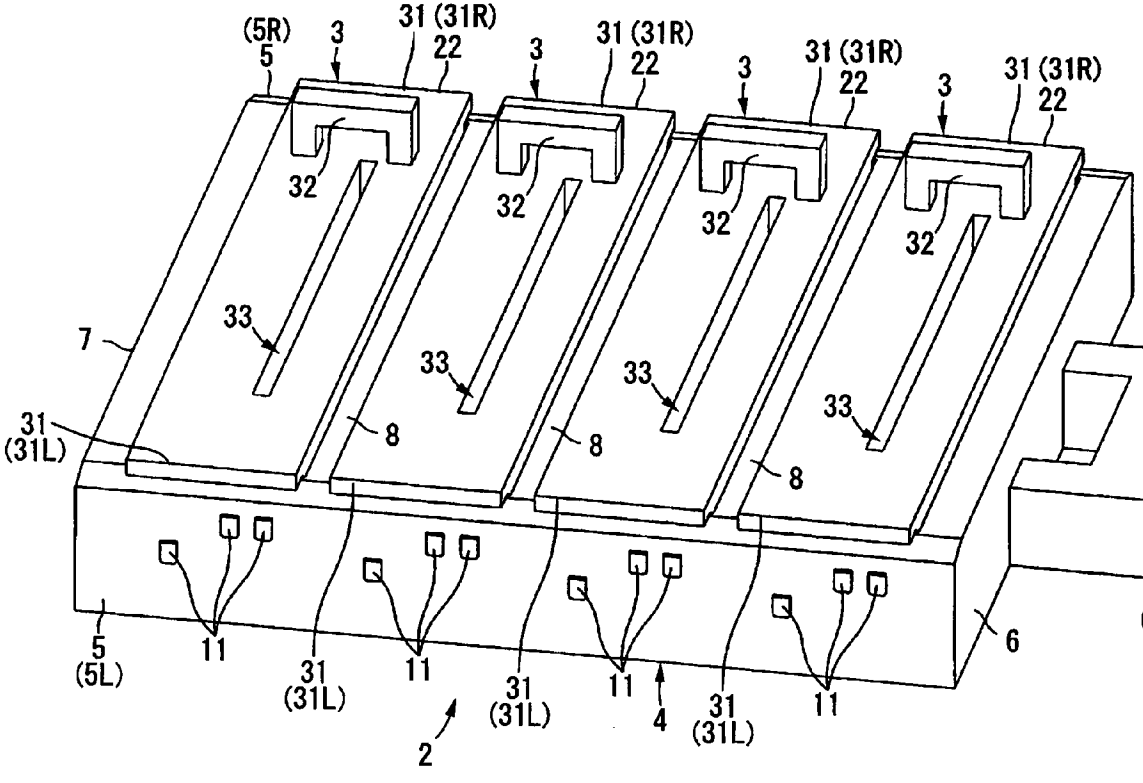
FIG. 5A is a perspective view of the holder in a state where all cartridges are mounted, as seen from the left front side.

When all the four cartridges 3 are completely mounted in the holder 4 as shown in FIG. 5A, the left protruding portion 31L of the case 22 of each of the cartridges 3 abuts the left side plate 5L of the holder 4 from above and the right protruding portion 31R thereof abuts the right side plate 5R of the holder 4 from above. Accordingly, each of the cartridges 3 is positioned with respect to the holder 4 (the corresponding receiving area 10, see FIG. 2), so that the cartridge 3 is maintained as being mounted in the receiving area 10.

In this state, a portion of the case 22 of each of the cartridges 3, which is provided below the left and right protruding portions 31 (see FIG. 3), is housed within the corresponding receiving area 10 (see FIG. 2). The left side surface 22L (see FIG. 3) of the case 22 of each of the cartridge 3 opposes the right side surface (the left partition surface 9L) of the left side plate 5L (see FIG. 2) of the holder 4 from the right side, and the right side surface 22R (see FIG. 3) of the case 22 thereof opposes the left side surface (the right partition surface 9R) of the right side plate 5R (see FIG. 2) of the holder 4 from the left side (see also FIG. 8 to be described below).

Figure 6:
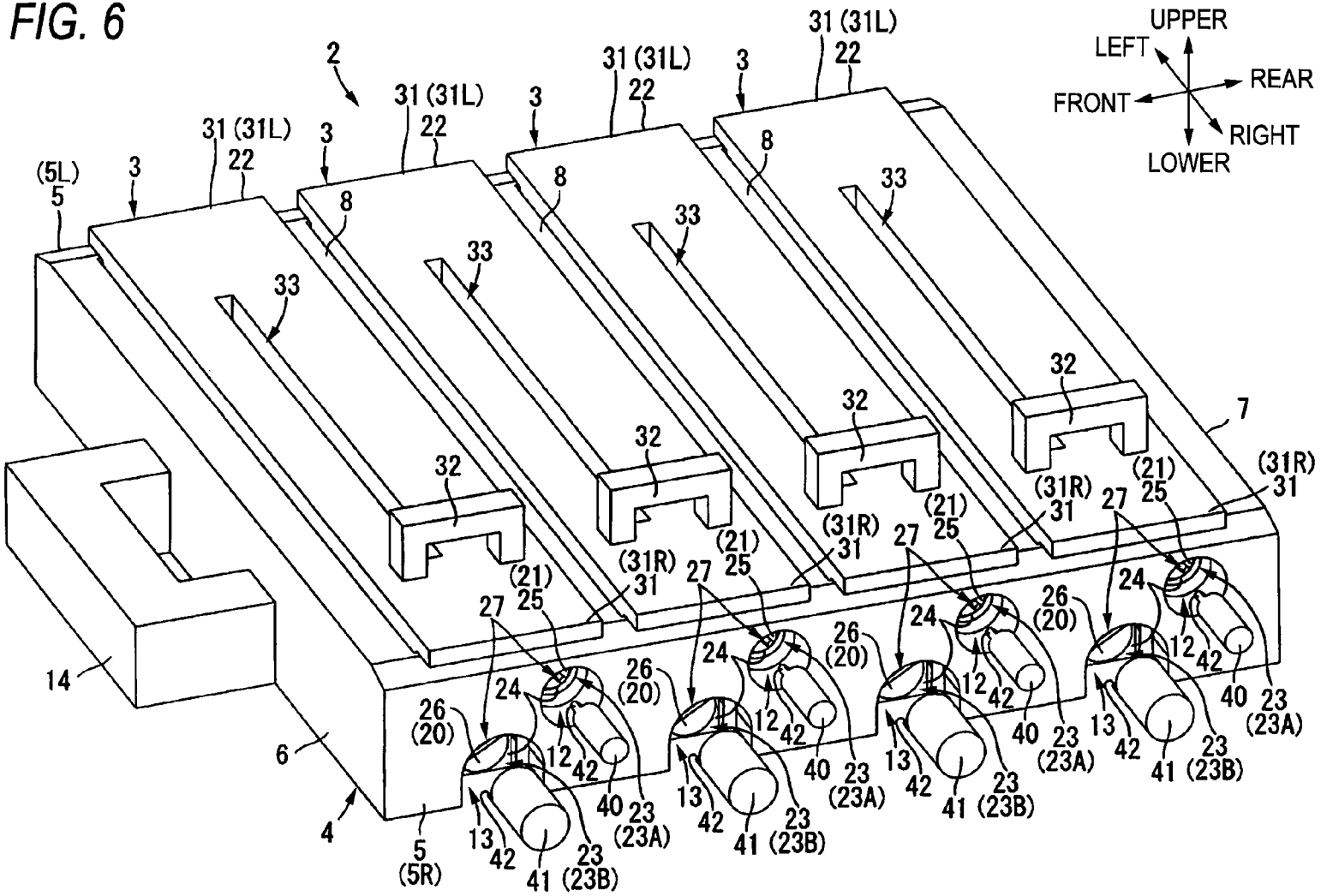
FIG. 6 is a perspective view of the holder in a state where all cartridges are mounted, as seen from the right front side.

Further, in this state, as shown in FIG. 6, the first transmission part 25 of each of the cartridges 3 is exposed to the right side from the corresponding insertion hole 12 of the right side plate 5R of the holder 4 and the second transmission part 26 thereof is exposed to the right side from the corresponding notch 13 of the right side plate 5R of the holder 4.

Figure 7:
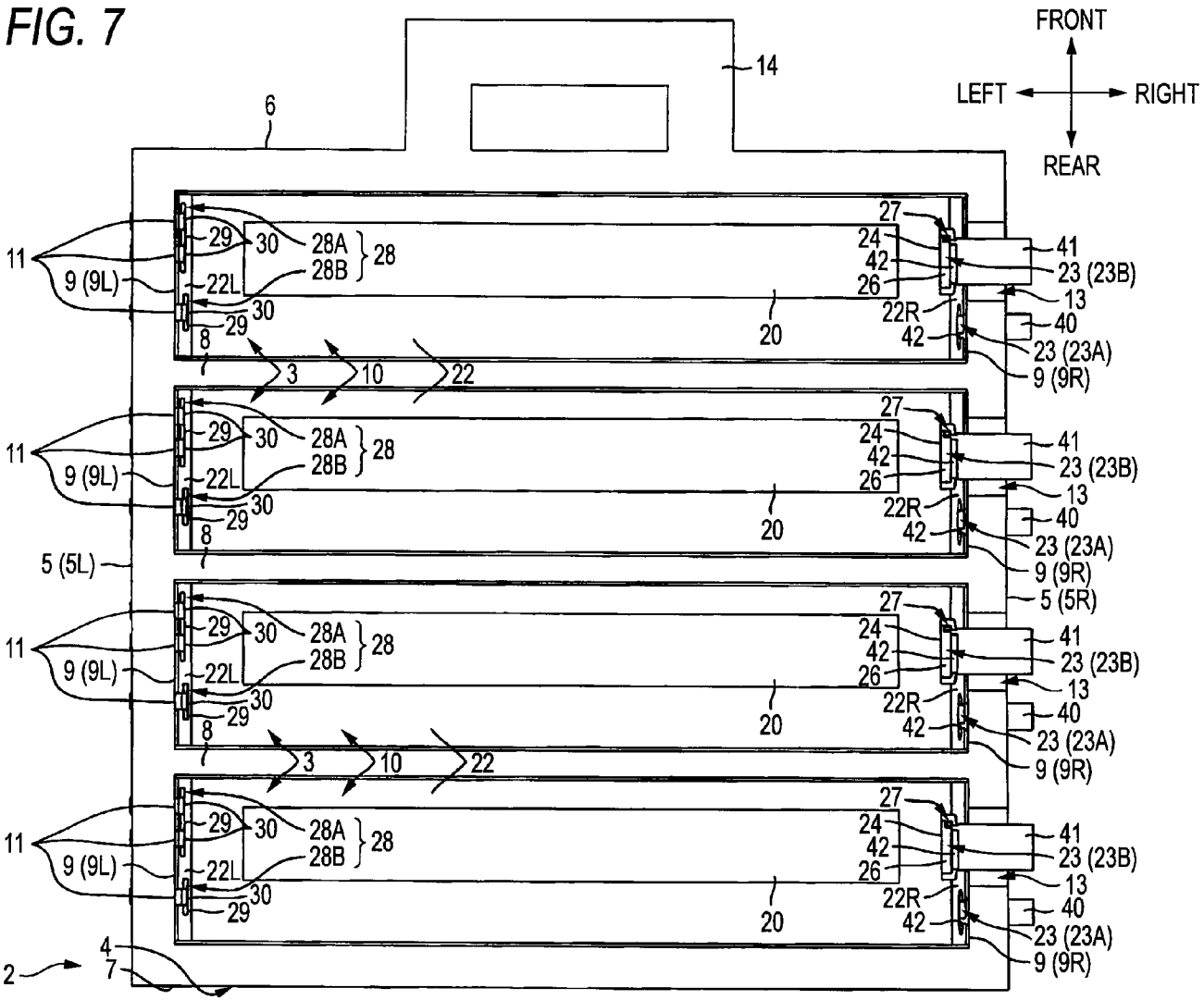
FIG. 7 is a bottom view of the holder in a state where all cartridges are mounted.

Further, as shown in FIG. 7, the outer peripheral surface of the photosensitive drum 20, which is exposed to the lower surface of the case 22 of each of the cartridges 3, is exposed to the lower side from the receiving area 10 which is opened downward. Accordingly, during an image formation, the electrostatic latent image (toner image) developed on the photosensitive drum 20 of each of the cartridges 3 is transferred to a recording medium from the outer peripheral surface of the photosensitive drum 20, which is exposed to the lower side.

Further, when the cartridges 3 are mounted in the holder 4 as shown in FIG. 5A, the three electrodes 30 (see FIG. 3B) of the left side surface 22L of the case 22 of the cartridge 3 are connected to the corresponding electrodes 11 (see also FIG. 2) of the left side plate 5L of the holder 4 as shown in FIG. 5B. Specifically, each of the electrodes 11 enters the left recess 28B of the left side surface 22L of the case 22 by own elastic force, and comes into press contact with the corresponding electrode 30 from the left side (see also FIG. 7). Accordingly, power can be supplied to the respective electrodes 30 from a power source (not shown) of the body casing 2 through the electrodes 11.

Here, as shown in FIG. 6, the body casing 2 is provided with four first input parts 40 and four second input parts 41 on the right side of the right side plate 5R of the holder 4.

The four first input parts 40 are aligned at regular intervals in the front-rear direction, and each of the first input parts 40 corresponds to the insertion hole 12, which is positioned at the same position as the position of each of the first input part in the front-rear direction, as seen from the right side.

The four second input parts 41 are provided below the four first input parts 40. The four second input parts 41 are aligned at regular intervals in the front-rear direction, and each of the second input parts 41 corresponds to the notch 13, which is positioned at the same position as the position of each of the second input part in the front-rear direction, as seen from the right side.

Each of the first and second input parts 40 and 41 has a cylinder shape extending in the width direction, and integrally provided with a protrusion 42 which protrudes toward the left side from the left side surface thereof. Each of the protrusions 42 passes through the center of the circular shape of the corresponding input part of the first and second input parts 40 and 41 and linearly extends in the radial direction of the input part.

The rear end of each of the first and second input parts 40 and 41 is connected to a driving source (not shown) of the body casing 2. Accordingly, during an image formation, each of the first and second input parts 40 and 41 receives a driving force generated by the driving source (not shown) and is rotated about the axis thereof.

Further, each of the first and second input parts 40 and 41 can freely advance and retreat in the left-right direction. In FIG. 6, both the first and second input parts 40 and 41 are positioned at retreat positions and positioned on the right side of the right side plate 5R of the holder 4.

The first and second input parts 40 and 41, which are positioned at advance positions, are shown in FIGS. 1 and 7. The first and second input parts 40 and 41, which are positioned at advance position as shown in FIG. 1, are moved to the left side in comparison with when the first and second input parts are positioned at the retreat positions (see FIG. 6).

Each of the first input parts 40, which are positioned at the advance positions, is inserted into the corresponding insertion hole 12 (which is positioned at a position corresponding to the first input part as seen from the right side) from the right side. Each of the second input parts 41, which are positioned at the advance positions, is inserted into the corresponding notch 13 (which is positioned at a position corresponding to the second input part as seen from the right side) from the right side. Accordingly, one first input part 40 and one second input part 41 opposes the corresponding receiving area 10 (see FIG. 2).

Specifically, in this state, the protrusion 42 (see FIG. 6) of the first input part 40 is fitted to the groove 27 (see FIG. 6) of the first transmission part 25 of the corresponding cartridge 3, which is mounted on the receiving area 10, from the right side (see also FIG. 7). Further, the protrusion 42 (see FIG. 6) of the second input part 41 is fitted to the groove 27 (see FIG. 6) of the second transmission part 26 of the corresponding cartridge 3, which is mounted on the receiving area 10, from the right side (see also FIG. 7).

That is, as shown in FIG. 7, the first input part 40, which is positioned at the advance position, is connected to the first transmission part 25 (see FIG. 6) of the corresponding cartridge 3 and the second input part 41, which is positioned at the advance position, is connected to the second transmission part 26 of the corresponding cartridge 3.

Accordingly, during an image formation, when each of the first and second put parts 40 and 41 receives a driving force generated by a driving source (not shown) and is rotated as described above, a driving force is transmitted to the first transmission part 25 from the first input part 40, so that the driving force is transmitted to the second transmission part 26 from the second input part 41. Therefore, referring to FIG. 3A, the first and second transmission parts 25 and 26 of each of the cartridges 3 are also rotated like the first and second input parts 40 and 41.

Additionally, since the first transmission part 25 is formed integrally with the developing roller 21 and the second transmission part 26 is formed integrally with the photosensitive drum 20 as described above, a driving force is transmitted to the developing roller 21 from the first transmission part 25 as the first and second transmission parts 25 and 26 are rotated, so that the driving force is transmitted to the photosensitive drum 20 from the second transmission part 26. Accordingly, the photosensitive drum 20 and the developing roller 21 are driven so as to rotate as described above.

Further, when the cartridge 3 is detached from the holder 4 (the corresponding receiving area 10, see FIG. 2) to supply toner to the cartridge 3 or replace the cartridge 3 after the completion of an image formation, the first and second input parts 40 and 41, which are positioned at the advance positions (see FIG. 1), are moved to the right side and retreat into the retreat positions thereof shown in FIG. 6 before the separation of the cartridge 3.

The left and right side surfaces 22L and 22R of the case 22 of the cartridge 3 will be described in detail below with reference to FIG. 8. Here, for ease of description, the electrodes 11 (see FIG. 2) of the holder 4 and the first and second input parts 40 and 41 (see FIG. 6) are not shown in FIG. 8 as well as FIGS. 9, 10, 11, and 13 to be described below (the electrodes 11 are shown in FIG. 9).

Figure 8:
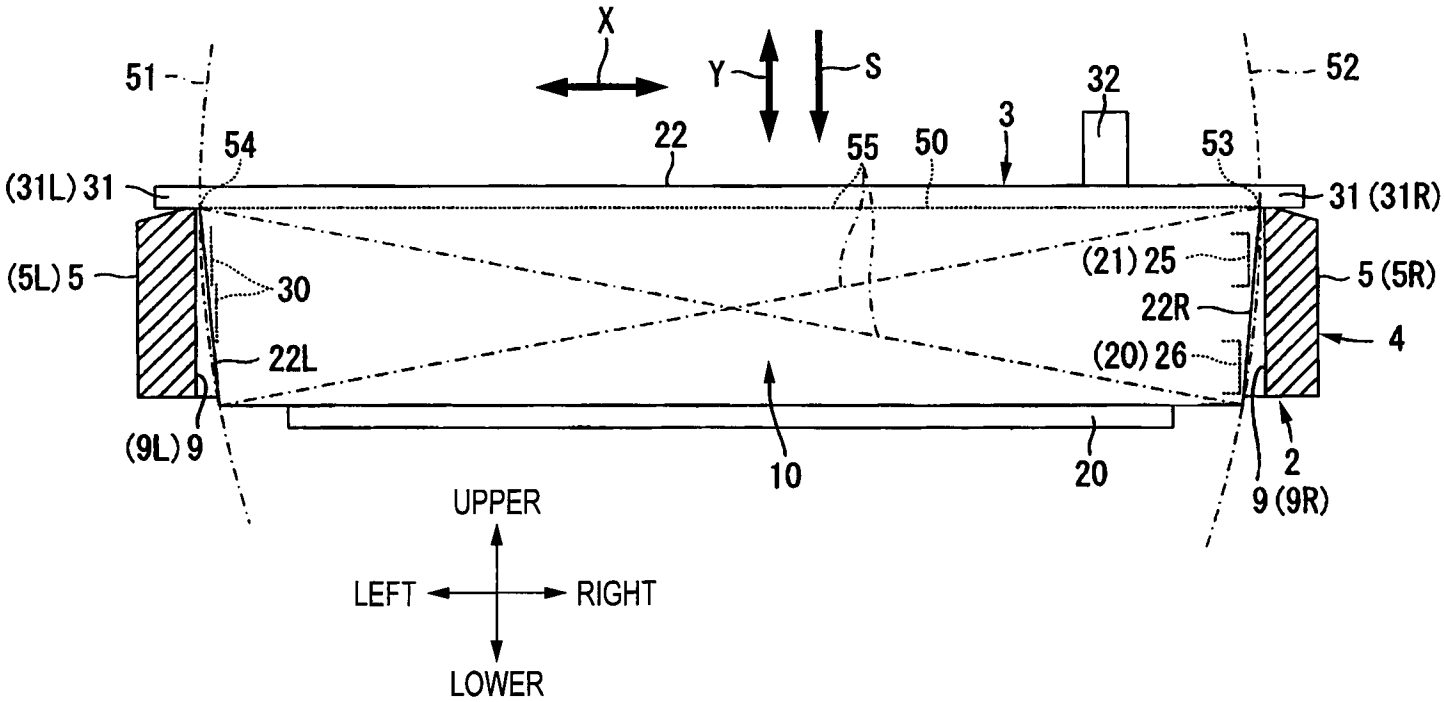
FIG. 8 is a front cross-sectional view of the holder in a state where a cartridge is mounted.
Figure 9:
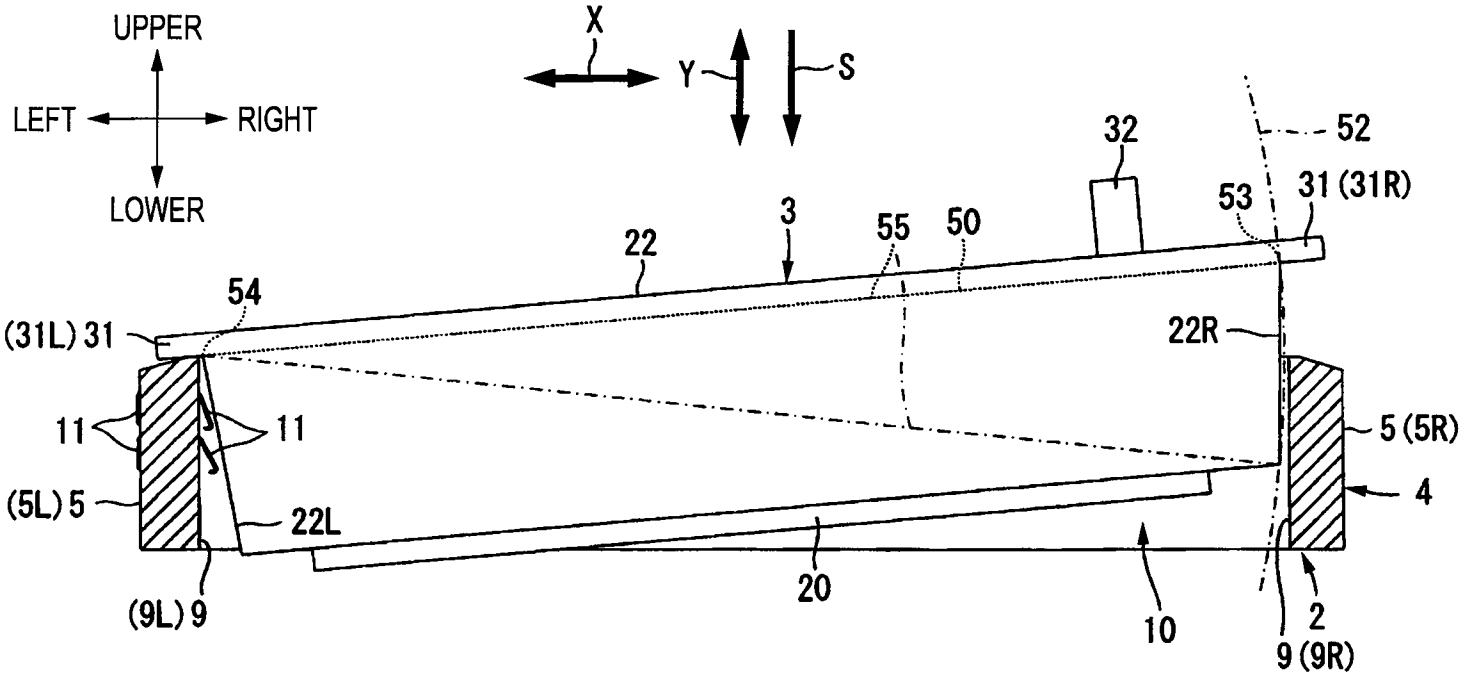
FIG. 9 is a view showing a front cross-sectional view of the holder when the cartridge is mounted in or detached from the holder of FIG. 8.

FIG. 8 shows the outlines of the left and right side surfaces 22L and 22R when the cartridge 3 mounted in the holder 4 (the corresponding receiving area 10) is seen in the front-rear direction (the second direction Z).

First, a portion of the case 22, both end of which contacts (is contactable with) the pair of partition surfaces 9 of the holder 4, respectively, is from immediately below the left and right protruding portions 31, and the most upstream end 50 of this portion in the mounting direction S (a direction toward the lower side) is shown by a dotted line in FIG. 8.

Further, first and second circular arcs 51 and 52 are shown in FIG. 8. The center of curvature of the first circular arc 51 is at a right end 53 (a second end) of the most upstream end 50 in the width direction (the opposing direction X), and the radius of curvature of the first circular arc 51 corresponds to a line segment 55 which connects both ends (the right and left ends 53 and 54) of the most upstream end 50 in the width direction.

The center of curvature of the second circular arc 52 is at the left end 54 (a first end) of the most upstream end 50 in the width direction, and the radius of curvature of the second circular arc 52 corresponds to the line segment 55 same as that of the first circular arc 51.

The left side surface 22L is inclined toward the right lower side so that the outline of the left side surface 22L is provided inside the first circular arc 51 as seen in the front-rear direction (the second direction Z). Here, the outline of the left side surface 22L may be provided on the first circular arc 51 as seen in the front-rear direction. In other words, the outline of the left side surface 22L may have a circular arc shape along the first circular arc 51. However, in this case, the left side surface 22L is provided so that any part of the outline of the left side surface does not protrude outward from the first circular arc 51.

Similarly, the right side surface 22R is inclined toward the left lower side so that the outline of the right side surface 22R is provided inside the second circular arc 52 as seen in the front-rear direction (the second direction Z). Here, the outline of the right side surface 22R may be provided on the second circular arc 52 as seen in the front-rear direction. In other words, the outline of the right side surface 22R may have a circular arc shape along the second circular arc 52. However, in this case, the right side surface 22R is provided so that any part of the outline of the right side surface does not protrude outward from the second circular arc 52.

According to the above-described exemplary embodiment, when the cartridge 3 is mounted in or detached from the receiving area 10, there is no concern that the cartridge 3 is hung on the partition surface 9 even though the posture of the cartridge 3 is inclined as shown in FIG. 9.

Specifically, when the cartridge 3 is detached from the receiving area 10, the grip part 32 provided close to the right side is gripped and pulled up. Accordingly, the cartridge 3 is rotated about the left end 54 so that the portion of the cartridge corresponding to the grip part 32 (the right portion of the cartridge 3) ascends.

Accordingly, when the cartridge 3 is detached from the receiving area 10, the posture of the cartridge 3 is inclined. However, the left and right side surfaces 22L and 22R of the case 22 of the cartridge 3 are moved inside or on the first circular arc 51 (see FIG. 8) and the second circular arc 52, and do not come into contact with the partition surfaces 9 of the holder 4. Subsequently, when the cartridge 3 is moved up to a position above the receiving area 10 while the left and right side surfaces 22L and 22R do not come into contact with the partition surfaces 9, the detaching of the cartridge 3 from the receiving area 10 is completed.

In contrast, when the cartridge 3 is mounted in the receiving area 10, the grip part 32 is gripped and the cartridge 3 is pushed down. In this course, the posture of the cartridge 3 is inclined so that the left end 54 is lower than the right end 53, and the left end 54 of the cartridge 3 initially comes into contact with the holder 4 (specifically, the upper end of the left partition surface 9L). Subsequently, when the cartridge 3 is pushed down, the cartridge 3 is rotated about the left end 54 so that the portion of the cartridge corresponding to the grip part 32 (the right portion of the cartridge 3) descends.

In this course, the posture of the cartridge 3 continues to be inclined, however, the left and right side surfaces 22L and 22R of the case 22 of the cartridge 3 are moved inside or on the first circular arc 51 (see FIG. 8) and the second circular arc 52, and do not come into contact with the partition surfaces 9 of the holder 4. Further, when the cartridge 3 is rotated until the right end 53 (specifically, right protruding portion 31R) of the cartridge 3 comes into contact with the holder 4 (the right side plate 5R), the rotation of the cartridge 3 is stopped and the mounting of the cartridge 3 in the receiving area 10 is completed (see FIG. 8).

Referring to FIG. 8, it is advantageous that the outline of each side surface (the left and right side surfaces 22L and 22R) is close to the corresponding one of the first and second circular arcs 51 and 52 as seen in the second direction Z (the front-rear direction). This is because, when the cartridge 3 is mounted in the receiving area 10, the distance between each of the left and right side surfaces 22L and 22R and the corresponding partition surface 9 (the left partition surface 9L or the right partition surface 9R) becomes small. Therefore, it is possible to suppress the rattling of the cartridge as much as possible (up to the rattling in an acceptable range of, for example, about 1 to 3 mm) when the cartridge 3 is mounted in the receiving area 10.

Accordingly, it is possible to smoothly mount or detach the cartridge 3 in or from the receiving area 10 while suppressing the rattling of the cartridge 3 in a mounting state in the receiving area 10 of the body casing 2 of the printer 1.

Figure 10:
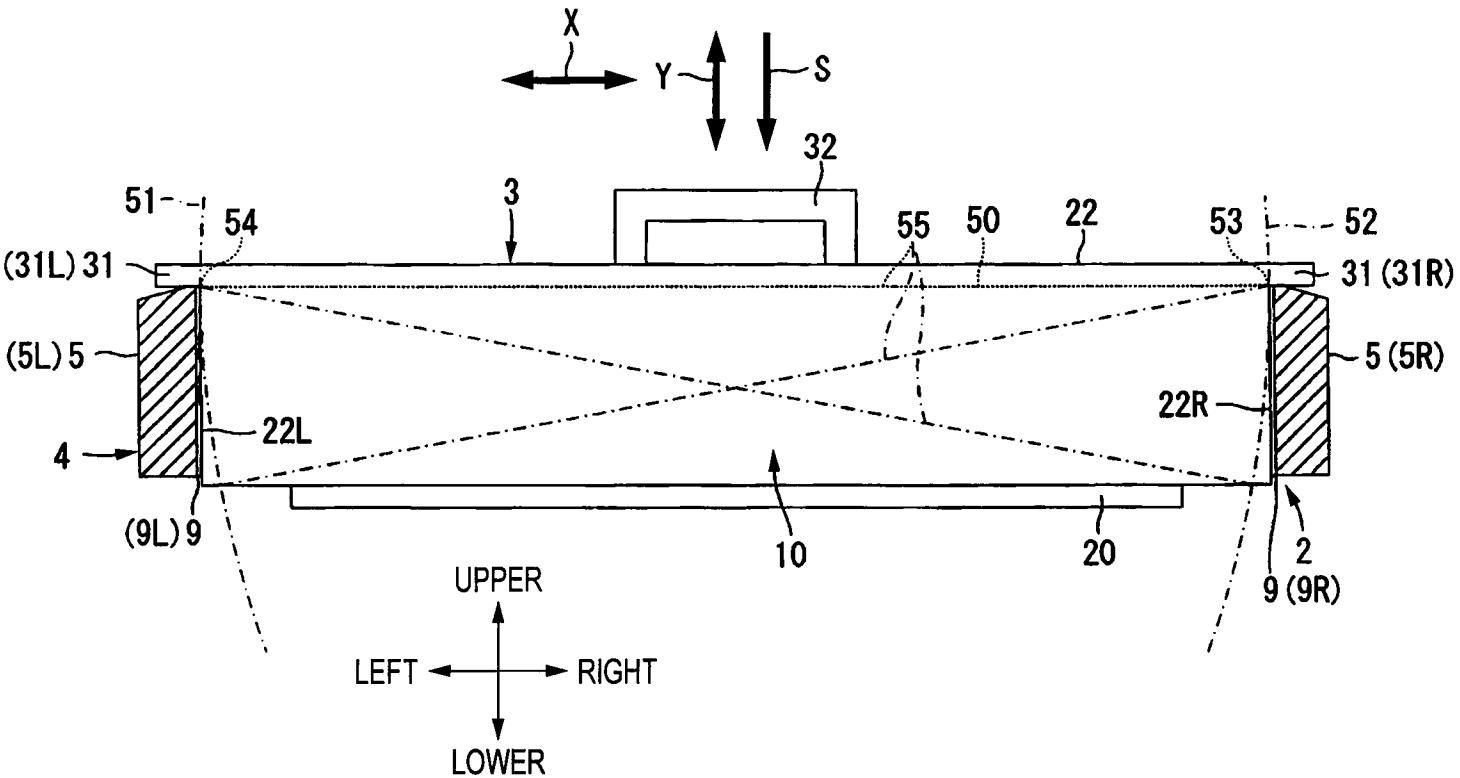
FIG. 10 is a view showing a front cross-sectional view wherein a cartridge according to a comparative example is employed in FIG. 8.

In contrast to the cartridge 3 according to the above-described exemplary embodiment, FIG. 10 shows a cartridge 3 in which either one of the outlines of the left and right side surfaces 22L and 22R is provided outside the corresponding one of the first and second circular arcs 51 and 52 as seen in the second direction Z (the front-rear direction). In this case, if the cartridge 3 is mounted in or detached from the receiving area 10 while the posture of the cartridge is inclined by even a small amount, there is concern that the one of the side surfaces (the left and right side surfaces 22L and 22R) of the cartridge 3 is hung on the partition surface 9, and the cartridge 3 becomes locked between the left and right partition surface 9 while being inclined.

According to the above-described exemplary embodiment, the right flat surfaces 24, which are parallel to the first direction Y (the upper-lower direction), are formed on the right side surface 22R of the case 22 of the cartridge 3 as shown in FIG. 3A. Further, the first and second transmission parts 25 and 26 configured to receive a driving force from the body casing 2 and transmit the driving force to the photosensitive drum 20 and the developing roller 21 of the cartridge 3 are provided on the right flat surfaces 24.

Accordingly, comparing with a case in which the first and second transmission parts 25 and 26 are provided on curved surfaces, it is possible to stably connect the first and second transmission parts 25 and 26 to the body casing 2 (the first and second input parts 40 and 41) (see FIGS. 1, 6, and 7), and to stably supply a driving force to the first and second transmission parts 25 and 26 from the body casing 2.

Further, it is possible to simplify the structure by providing the right flat surfaces 24 on the recessed portions (the right recesses 23) of the right side surface 22R.

Further, as shown in FIG. 4, the grip part 32 is provided on the upstream end portion of the case 22 (the upper surface of the case 22) in the mounting direction S where the cartridge 3 is mounted on the receiving area 10, at the position apart from the center of the case in the opposing direction X (the width direction). Accordingly, it is possible to mount or detach the cartridge 3 in or from the receiving area 10 by gripping the grip part 32 with one hand, which is convenient. However, when the grip part 32, which is positioned at the position apart from the center of the case 22 in the width direction, is gripped and the cartridge 3 is mounted in or detached from the receiving area 10, the posture of the cartridge 3 is necessarily inclined (see the foremost cartridge 3).

However, according to the above-described exemplary embodiment, as seen in the second direction Z (the front-rear direction), each of the outlines of the left and right side surfaces 22L and 22R of the case 22 is provided inside or on the corresponding one of the first and second circular arcs 51 and 52 as described above in FIG. 8. Accordingly, when the cartridge 3 is mounted in or detached from the receiving area 10, there is no concern that the cartridge 3 is hung on the partition surface 9 even though the posture of the cartridge 3 is inclined (see FIG. 9).

Further, referring to FIG. 3, the electrodes 30, which receive power from the body casing 2, are provided on the left side surface 22L opposing the right side surface 22R, where the first and second transmission parts 25 and 26 are provided, of the pair of side surfaces of the case 22 in the width direction.

Accordingly, it is possible to provide all the electrodes 30, which become resistance during the mounting or detaching and make the posture of the cartridge 3 unstable, on one end (the left side surface 22L) of the case 22 of the cartridge 3 without the deterioration of operability.

2. Modification

While the present invention has been shown and described with reference to certain exemplary embodiments thereof, it will be understood by those skilled in the art that various changes in form and details may be made therein without departing from the spirit and scope of the invention as defined by the appended claims.

(1) First Modified Exemplary Embodiment

In the above-described exemplary embodiment, when the cartridge 3 is mounted in the holder 4 (the receiving area 10), the left and right protruding portions 31 formed on the upper surface of the case 22 abut the left and right side plates 5L and 5R of the holder 4, respectively, from above (see FIG. 8).

Figure 11:
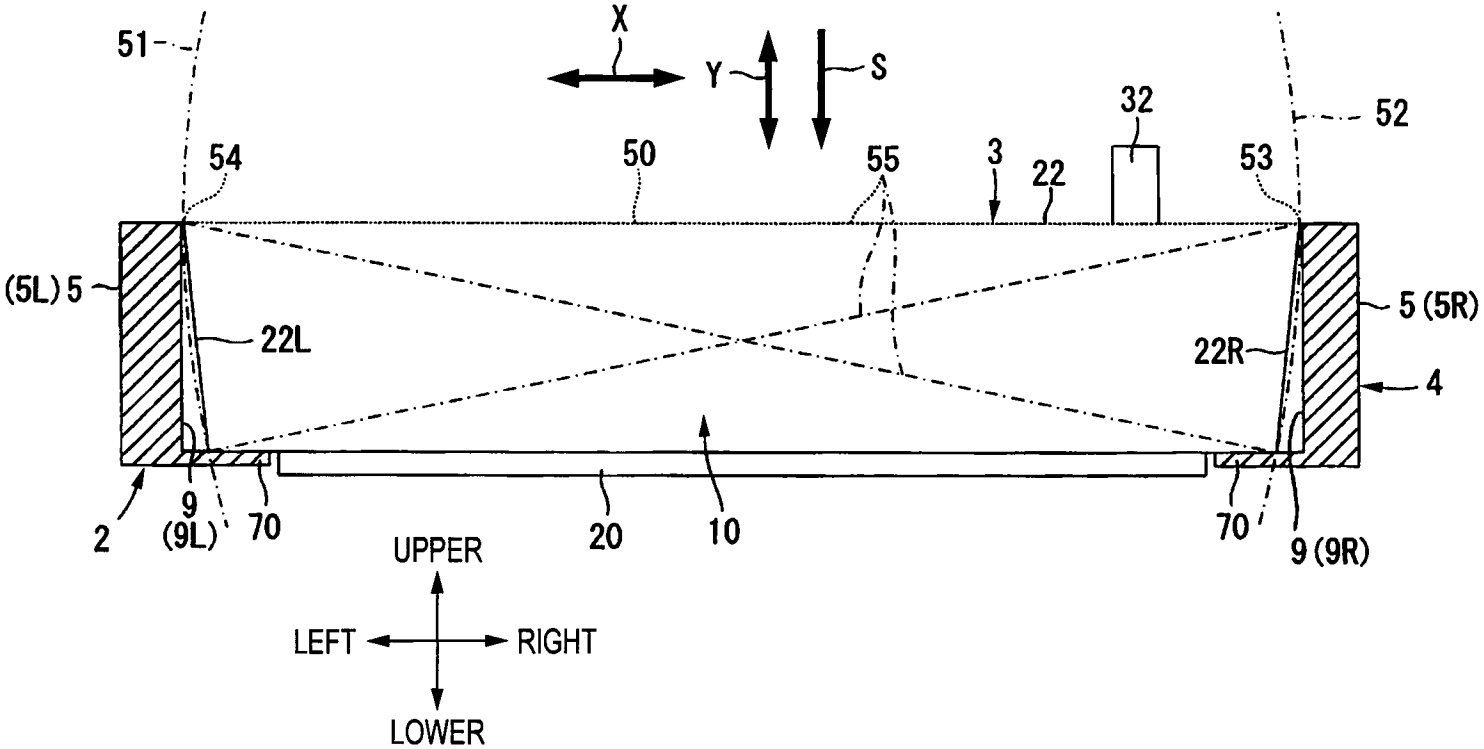
FIG. 11 is a view showing a front cross-sectional view wherein a cartridge according to a first modified exemplary embodiment is employed in FIG. 8.

However, the left and right protruding portions 31 of the case 22 may be not provided as shown in FIG. 11. In this case, protrusions 70 which protrude toward the inside of the respective receiving areas 10 in the width direction are integrally formed on the lower ends of the respective left and right side plates 5 of the holder 4.

In the first modified exemplary embodiment, when the cartridge 3 is mounted in the holder 4 (the receiving area 10), the cartridge 3 is placed on the left and right protrusions 70 and positioned in the holder 4 (the corresponding receiving area 10).

Accordingly, the cartridge 3 is maintained as being mounted in the receiving area 10. Meanwhile, in this state, each of the protrusions 70 does not interfere with the photosensitive drum 20 which is exposed to the lower surface of the case 22 of the cartridge 3.

Further, in the first modified exemplary embodiment, as seen in the second direction Z (the front-rear direction), each of the outlines of the left and right side surfaces 22L and 22R of the case 22 is provided on or inside the corresponding one of the first and second circular arcs 51 and 52.

(2) Second Modified Exemplary Embodiment

In the above-described exemplary embodiment, the flat surfaces (the right and left flat surfaces 24 and 29) where the first and second transmission parts 25 and 26 and the electrodes 30 are provided as shown in FIG. 3 are provided in the portions (the right recess 23 or the left recess 28) which are recessed from the corresponding side surface (the left side surface 22L or the right side surface 22R) of the case 22. Accordingly, ratios of the areas the corresponding right and left flat surfaces 24 and 29 to the areas of the left and right side surfaces 22L and 22R are relatively small.

Figure 12B:
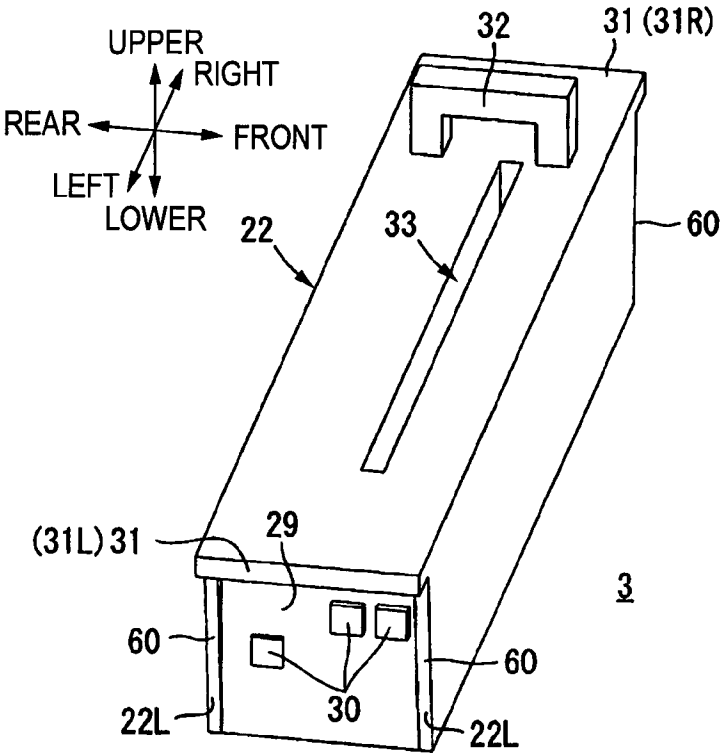
FIG. 12B is a perspective view of the cartridge according to the second modified exemplary embodiment as seen from the left front side.
Figure 12A:
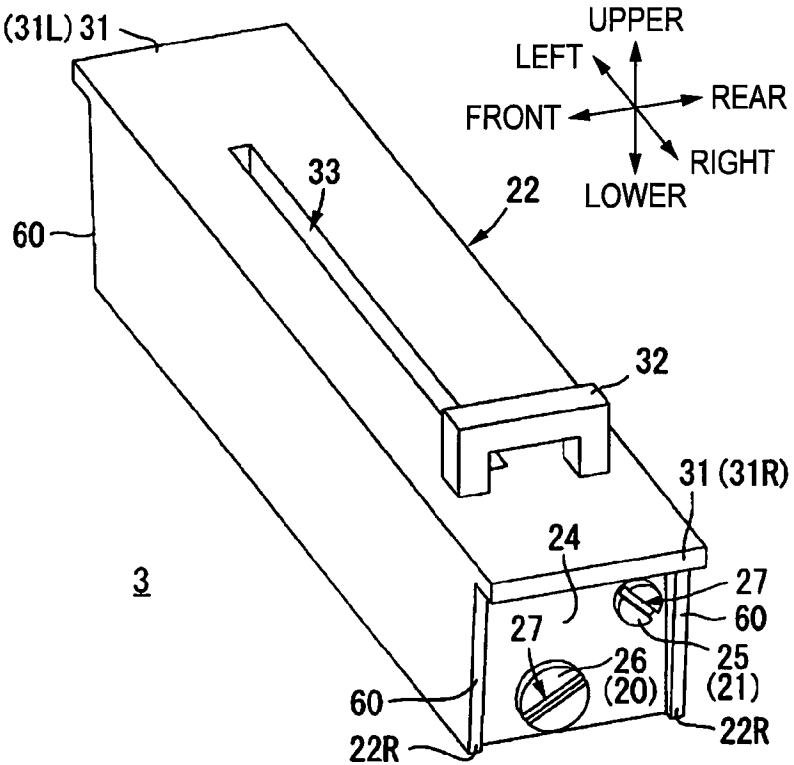
FIG. 12A is a perspective view of a cartridge according to a second modified exemplary embodiment as seen from the right front side.

Instead, it is conceivable that ribs 60 are formed on the case 22 as shown in FIGS. 12A and 12B. The ribs 60 are formed on the right and left flat surfaces 24 and 29, respectively.

In the right flat surface 24 shown in FIG. 12A, the ribs 60 are formed on both ends of the right flat surface 24 in the front-rear direction (the second direction Z). Each of the ribs 60 protrudes from the ends of the right flat surface 24 in the front-rear direction toward the outside (the right side) in the width direction (the opposing direction X) from the right flat surface 24.

In the left flat surface 29 shown in FIG. 12B, the ribs 60 are formed on both ends of the left flat surface 29 in the front-rear direction (the second direction Z). Each of the ribs 60 protrudes from the ends of the left flat surface 29 in the front-rear direction toward the outside (the left side) in the width direction (the opposing direction X) from the left flat surface 29.

Figure 13:
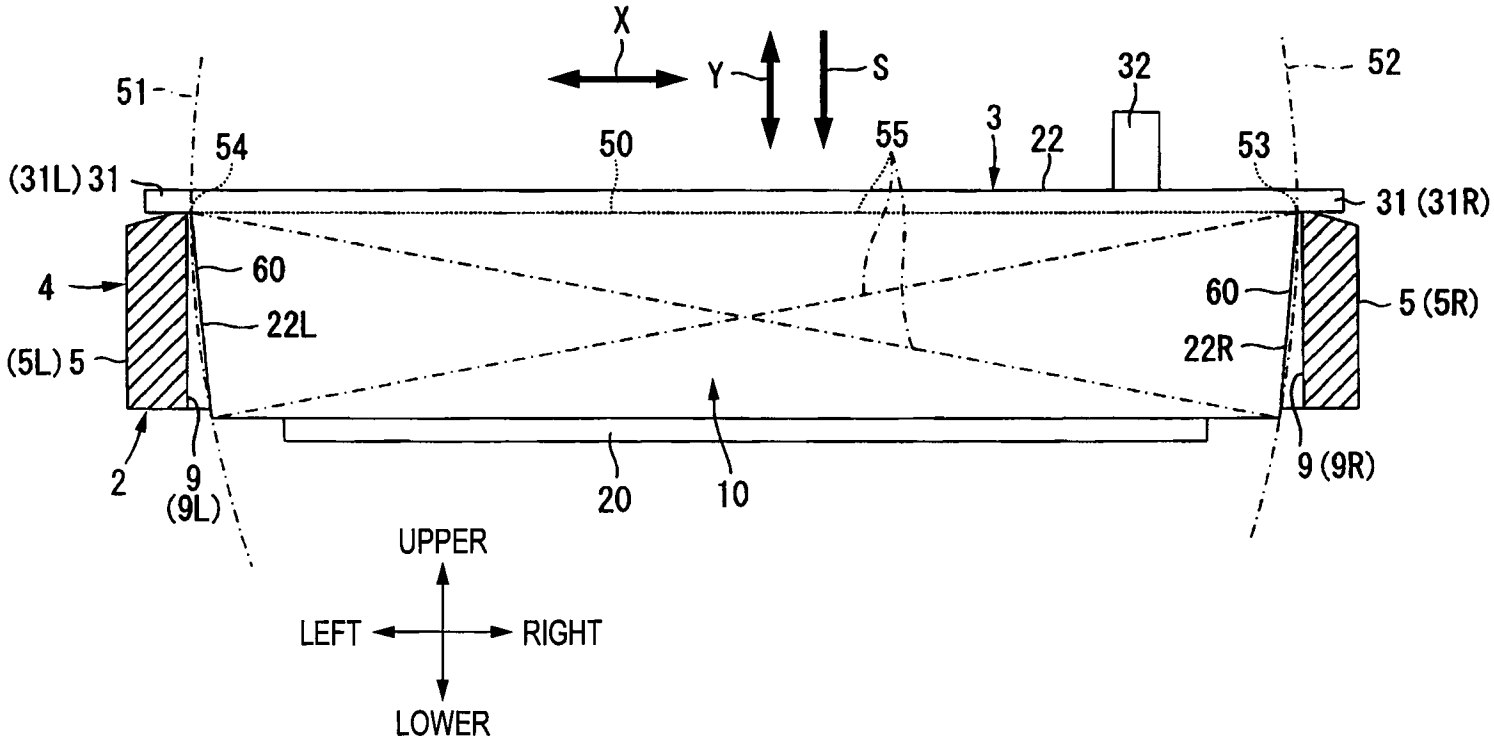
FIG. 13 is a view showing a front cross-sectional view wherein the cartridge according to the second modified exemplary embodiment is employed in FIG. 8.

Further, as shown in FIG. 13, the ribs 60 provided on the right and left flat surfaces 24 and 29 configure the outlines of the left and right side surface 22L, 22R, respectively, as seen in the front-rear direction (second direction Z).

That is, the left end face of the rib 60 (the left rib 60 in FIG. 13) of the left flat surface 29 forms the left side surface 22L of the above-described exemplary embodiment, and is provided on or inside the first circular arc 51 as seen in the front-rear direction. The right end face of the rib 60 (the right rib 60 in FIG. 13) of the right flat surface 24 forms the right side surface 22R of the above-described exemplary embodiment, and is provided on or inside the second circular arc 52 as seen in the front-rear direction.

According to the second modified exemplary embodiment, it is possible to easily form the outlines of the left and right side surfaces 22L and 22R of the case 22 in the width direction as seen in the second direction Z (the front-rear direction) only by providing the ribs 60 on the case 22.

(3) Other Modified Exemplary Embodiments

Figure 14B:
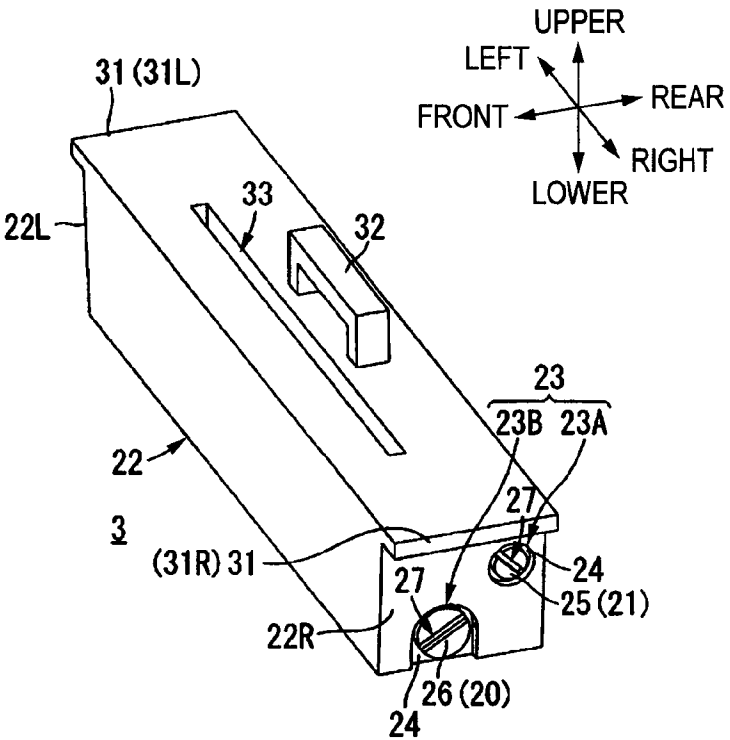
FIG. 14B is a perspective view of a cartridge according to a fourth modified exemplary embodiment as seen from the right front side.
Figure 14A:
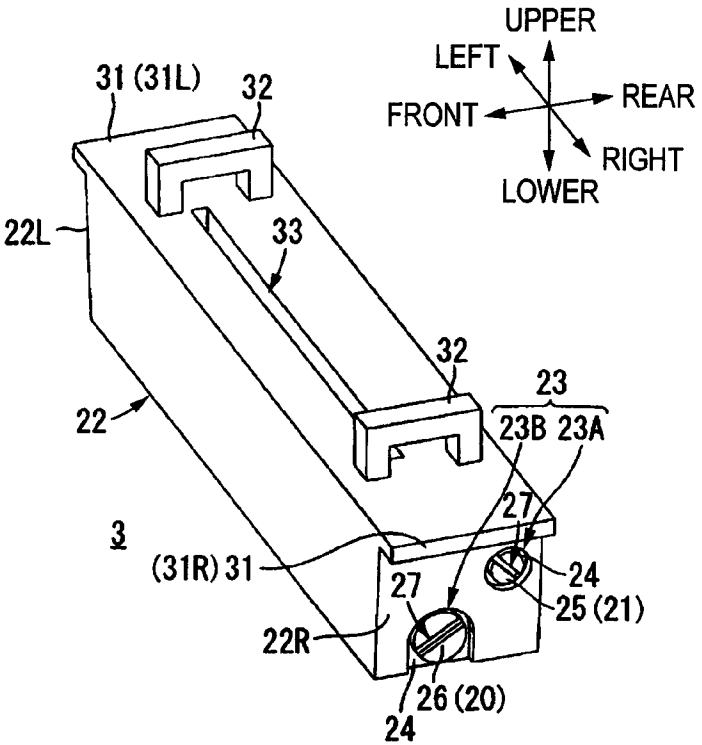
FIG. 14A is a perspective view of a cartridge according to a third modified exemplary embodiment as seen from the right front side.

As shown in FIG. 14A, a cartridge 3 according to a third modified exemplary embodiment is provided with two grip parts 32 with a distance therebetween on the upper surface of the case 22 to be symmetric with respect to the center of the upper surface of the case 22 in the width direction. Since two grip parts 32 are provided, it is possible to mount or detach the cartridge 3 in or from the holder 4 (a receiving area 10) at a stable posture with small inclination (as horizontal as possible).

As shown in FIG. 14B, a cartridge 3 according to a fourth modified exemplary embodiment is provided with one grip part 32 in the center of the upper surface of the case 22 in the width direction. According to the fourth modified exemplary embodiment, it is possible to obtain same advantages as those of the third modified exemplary embodiment. However, the cartridge 3 according to the fourth modified exemplary embodiment may be easily inclined by several factors, such as the way of gripping the grip part 32, the deviation of the centroid of the cartridge 3 which is caused by the bias of the toner in the case 22, or the friction between the electrodes 30 of the left side surface 22L and the electrodes 11 (see FIG. 7) of the holder 4. Therefore, it might be difficult to actually mount or detach the cartridge 3 in or from the holder 4 (the receiving area 10) while maintaining the cartridge at a posture parallel to the horizontal direction all the time.

Figure 14C:
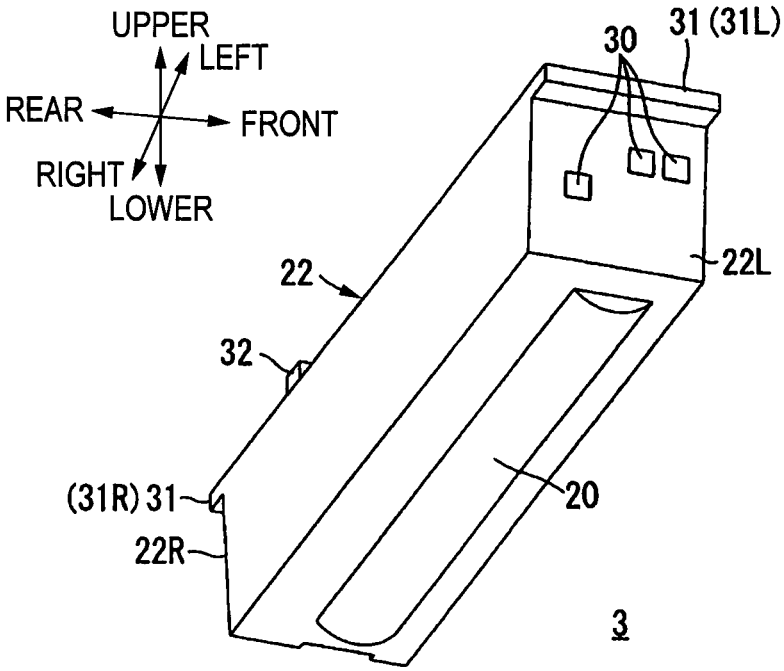
FIG. 14C is a perspective view of a cartridge according to a fifth modified exemplary embodiment as seen from the left rear side.

In the above-described exemplary embodiment, the electrodes 30 (see FIG. 3B) are provided on the left flat surfaces 29 of the left side surface 22L of the case 22 of the cartridge 3. However, according to a cartridge 3 according to a fifth modified exemplary embodiment, the electrodes 30 is provided on not the left flat surface 29 but the left side surface 22L as shown in FIG. 14C. In this case, the left side surface of each of the electrodes 30 needs to be at least flush with the left side surface 22L so as not to protrude from the left side surface 22L toward the outside (the left side) in the width direction.

In the cartridge 3 according to the fifth modified exemplary embodiment, since the left side surface 22L is inclined toward the right lower side (see FIG. 8) as described above, the left side surface of each of the electrodes 30 is also inclined toward the right lower side. Therefore, when the corresponding electrodes 11 (see FIG. 2) of the left side plate 5L of the holder 4 come into press contact with the respective electrodes 30 as described above (see FIG. 7), a part of a force of the electrode 11 pressing the electrode 30 is applied upward to the cartridge 3. Accordingly, there is a concern that the cartridge 3 is undesirably moved toward the upper side. Therefore, in this case, the cartridge 3 mounted in the receiving area 10 (sec FIG. 8) may be locked in the holder 4 by a locking member such as a click so that the cartridge 3 mounted in the receiving area 10 is not moved toward the upper side.

Further, in the above-described exemplary embodiment, the protruding portions 31 are provided integrally on both ends of the upper surface of the case 22. However, the protruding portions 31 are provided at the middle of the side surfaces 22L, 22R in the vertical direction (the first direction). In this case also, a portion of the case 22 which contacts the pair of partition surface 9 of the holder 4 is immediately below the left and right protruding portions 31.

Further, in the above-described exemplary embodiment, both the outlines of the left and right side surfaces 22L and 22R are provided on or inside the first and second circular arcs 51, 52, respectively. However, the present invention is not limited thereto. That is, the outline of only the right side surface 22R, at a side of which the grip part 32 is provided, is provided on or inside the second circular arc 52, and the outline of the left side surface 22L may be flat in parallel to the vertical direction (the first direction). In this case, when the cartridge 3 is mounted in the receiving area 10 while the grip part 32 is gripped, since the left end 54 becomes lower than the right end 53, at a side of which the grip part 32 is provided, the left end 54 initially comes into contact with the upper end of the left partition surface 9L. Subsequently, the cartridge 3 is rotated about the left end 54 so that the right end 53 descends. In this course, since the right side surface 22R is moved inside or on the second circular arc 53, the right side surface 22R does not contact with the partition surface 9.

What is claimed is:

1. A cartridge detachably mountable in a receiving area of an image forming apparatus in a first direction, the receiving area being partitioned by a first partition surface and a second partition surface opposing each other in an opposing direction, the first direction being orthogonal to the opposing direction, the cartridge comprising:

a case which is long in the opposing direction and is configured to store developer, the case including a first side surface and a second side surface in the opposing direction, wherein the case has a first part and a second part, the first part being positioned at the first side surface and at a first junction part between an upper portion and a lower portion of the case, and the second part being positioned at the second side surface and at a second junction part between the upper portion and the lower portion of the case, wherein the first side surface extends from the first part to a bottom of the lower portion of the case and the second side surface extends from the second part to the bottom of the lower portion of the case, wherein an entire outline of the first side surface is provided on or inside a first circular arc as seen in a second direction orthogonal to the opposing direction and the first direction, the first circular arc having:

a first center of curvature positioned on the second part; and a first radius of curvature corresponding to a line segment connecting the first part and the second part, and wherein an entire outline of the second side surface is provided on or inside a second circular arc as seen in the second direction, the second circular arc having:

a second center of curvature positioned on the first part; and a second radius of curvature corresponding to the line segment.

2. The cartridge according to claim 1, further comprising:

a driven member configured to be driven by a driving force;

a flat surface provided on one of the first and second side surfaces and parallel to the first direction; and a transmission part provided on the flat surface and configured to receive a driving force from the apparatus body and transmit the driving force to the driven member.

3. The cartridge according to claim 2, further comprising:

a rib formed on the case and protruding from an end of the flat surface in the second direction toward an outside in the opposing direction so as to configure the outline of the one of the first and second side surfaces as seen in the second direction.

4. The cartridge according to claim 2, wherein the flat surface is provided in a recess formed on the one of the first and second side surfaces.

5. The cartridge according to claim 2, wherein an entirety of the transmission part is provided inside or on the outline of the one of the first and second side surface as seen in the second direction.

6. The cartridge according to claim 2, further comprising:

a grip part provided on an upstream end portion of the case in the mounting direction and spaced apart from a center of the case in the opposing direction.

7. The cartridge according to claim 2, further comprising:

an electrode provided on another one of the first and second side surfaces and configured to receive power from the apparatus body.

8. The cartridge according to claim 1, wherein the upper portion of the case includes first and second protruding portions which protrude from the first and second side surfaces in the opposing direction, respectively, and wherein the first junction part is located below the first protruding portion, and the second junction part is located below the second protruding portion.

9. The cartridge according to claim 1, wherein the case includes a developing roller having an axial direction parallel to the opposing direction.

10. A cartridge detachably mountable in a receiving area of an image forming apparatus in a first direction, the receiving area being partitioned by a pair of side walls opposing each other in an opposing direction, the first direction being orthogonal to the opposing direction, the cartridge comprising:

a case including:

first and second side surfaces opposing each other in the opposing direction, an upper surface, and a lower surface;

first and second protruding portions protruding from the first and second side surfaces, respectively, in the opposing direction;

a developing roller provided between the first and second side surfaces;

a grip part provided on the upper surface at a position between a center of the case and the second side surface in the opposing direction, wherein an entire outline of the second side surface is provided on or inside a circular arc as seen in a second direction orthogonal to the opposing direction and the first direction, wherein the second side surface extends from the lower surface to the second protruding portion, the circular arc having:

a center of curvature at which the first protruding portion protrudes from the first side surface; and a radius of curvature corresponding to a line segment connecting a surface position at which the first protruding portion protrudes from the first side surface and a position at which the second protruding portion protrudes from the second side surface.

11. The cartridge according to claim 10, wherein the first and second protruding portions configure a part of the upper surface.

12. A cartridge detachably mountable in an image forming apparatus in a first direction orthogonal to an opposing direction, the cartridge comprising:

a case which is long in the opposing direction and is configured to store developer, the case including a first side surface and a second side surface in the opposing direction, wherein the case has a first part and a second part, the first part being positioned at the first side surface and at a first junction part between an upper portion and a lower portion of the case, and the second part being positioned at the second side surface and at a second junction part between the upper portion and the lower portion of the case, wherein the first side surface extends from the first part to a bottom of the lower portion of the case and the second side surface extends from the second part to the bottom of the lower portion of the case, wherein an entire outline of the first side surface is provided on or inside a first circular arc as seen in a second direction orthogonal to the opposing direction and the first direction, the first circular arc having:

a first center of curvature positioned on the second part; and a first radius of curvature corresponding to a line segment connecting the first part and the second part, and wherein an entire outline of the second side surface is provided on or inside a second circular arc as seen in the second direction, the second circular arc having:

a second center of curvature positioned on the first part; and a second radius of curvature corresponding to the line segment.

* * * * *